US005933084A

United States Patent [19]

Ravier et al.

[11] Patent Number: 5,933,084

[45] Date of Patent: Aug. 3, 1999

[54] INDICATING LIGHT, ESPECIALLY FOR A MOTOR VEHICLE, HAVING AN IMPROVED APPEARANCE WHEN EXTINGUISHED

[76] Inventors: Jean-Paul Ravier, 15 avenue Galliéni, 94100 Saint Maur des Fosses; Benoist Fleury, 32 rue Robert Giraudineau, 94300 Vincennes, both of France

[21] Appl. No.: 08/956,849

[22] Filed: Oct. 23, 1997

[30] Foreign Application Priority Data

Oct. 25, 1996 [FR] France ..... 96 13160

[51] Int. Cl.[6] ..... G08B 5/00

[52] U.S. Cl. ..... 340/815.73; 340/458; 340/479; 340/815.55; 359/621; 359/622; 359/626

[58] Field of Search ..... 340/815.73, 815.55, 340/463, 479, 458; 359/463, 456, 457, 453, 362, 621, 622, 623, 625, 626; 362/248

[56] References Cited

U.S. PATENT DOCUMENTS

| | | | |
|---|---|---|---|
| 5,208,620 | 5/1993 | Mitsutake et al. | 353/74 |
| 5,241,416 | 8/1993 | Mitsutake et al. | 359/456 |
| 5,412,492 | 5/1995 | Zammit et al. | 359/48 |
| 5,420,720 | 5/1995 | Gal et al. | 359/626 |
| 5,479,279 | 12/1995 | Barbier et al. | 359/53 |
| 5,606,455 | 2/1997 | Eichenlaub | 359/463 |
| 5,615,045 | 3/1997 | Takuma et al. | 359/456 |
| 5,786,939 | 7/1998 | Watanabe | 359/626 |

FOREIGN PATENT DOCUMENTS

| | | |
|---|---|---|
| 0 081 361 | 6/1983 | European Pat. Off. . |
| 2 385 977 | 10/1978 | France . |
| 2 493 960 | 5/1982 | France . |
| 2 604 240 | 3/1988 | France . |
| 2 718 824 | 10/1995 | France . |
| 2 079 919 | 1/1982 | United Kingdom . |

OTHER PUBLICATIONS

French Search Report dated Jul. 18, 1997.

*Primary Examiner*—Edward Lefkowitz
*Assistant Examiner*—Davetta Woods
*Attorney, Agent, or Firm*—Morgan & Finnegan LLP

[57] ABSTRACT

An indicator light for a motor vehicle includes a light source and a reflector, which directs light from the light source in a forward direction on a first screen having lines of optical elements, which converge the light beam received from the reflector on a second screen in front of the first screen. The second screen includes, through at least part of its thickness, colored bands and translucent bands which are arranged alternately with each other over the height of the screen. In the first screen, the lines of optical elements are separated from each other by opaque colored bands, which are aligned with the colored bands of the second screen.

35 Claims, 2 Drawing Sheets

INDICATING LIGHT, ESPECIALLY FOR A MOTOR VEHICLE, HAVING AN IMPROVED APPEARANCE WHEN EXTINGUISHED

FIELD OF THE INVENTION

The present invention relates to side lights, especially for motor vehicles. The expression "side lights" is to comprise, in a broad sense, any device intended to be viewed from outside the vehicle and capable of emitting light for the purposes of giving an indication, whether or not such indication consists of, or includes, an illuminating function. For convenience therefore, these side lights will be referred to as indicating lights in this application.

BACKGROUND OF THE INVENTION

Such indicating lights have, in general terms, a number of different indicating functions, and tend to be grouped together to constitute multi-function indicating light units. Such functions may for example be those of a reversing light, a direction indicating light, a stop light for indicating that the brakes of the vehicle have been applied, and a fog light, in particular a rear fog light.

Current standards specify a colour for each of these functions when the indicating light is lit. Thus a multi-function indicator light must be arranged to emit light beams of different colours. On the other hand, styling designers tend to require indicator lights to have as uniform an appearance as possible when the light is extinguished. Thus, more generally, it is desirable to be able to provide an indicator light having an appearance (especially in regard to its colour) when extinguished which is different from its appearance when lit.

In order to respond to these opposed requirements, the company VALEO VISION has proposed indicator lights in which the general colour when extinguished is different from the colour of the light beam emitted by the indicator light when the latter is lit, these proposals being contained in particular in published French patent specifications Nos. 2 604 240 and 2 718 824.

In those documents, the indicator lights disclosed generally comprise a light source, together with means for recuperating light flux which are adapted to redirect the light flux emitted by the light source in a first direction of the indicator light unit. Also provided is a first screen which comprises optical elements adapted to converge the light beam towards translucent bands carried on a second screen, these translucent bands being arranged in the second screen alternately with colour bands. The second screen can be seen from outside.

Thus the appearance of the indicator lights when extinguished is determined by the coloured bands, while the light emitted by the indicator light is either not coloured at all, or it has a colour which is different from that of the coloured bands of the second screen.

DISCUSSION OF THE INVENTION

An object of the present invention is to improve even more the appearance of such an indicator light when extinguished. In particular, an object of the invention is to give the indicator light an appearance when extinguished which is even more uniform than before, and which conforms even more to the colour of the coloured bands of the second screen.

A further object of the present invention is to give the indicator light, in addition to the foregoing, an appearance of depth, which is much favoured by styling designers.

According to the invention, an indicator light, especially for motor vehicles, which comprises:

a light source;

flux recuperating means adapted to direct the light flux emitted by the light source in a first direction;

a first screen which includes lines of optical elements extending in a second direction substantially at right angles to the said first direction, the said optical elements being adapted to converge the light beam emitted from the flux recuperating means; and a second screen which includes, through at least part of its thickness, coloured bands arranged alternately with translucent bands, the said coloured and translucent bands being oriented in substantially the second direction, is characterised in that:

the said lines of optical elements are spaced apart from each other;

the first screen includes coloured opaque bands disposed between the lines of optical elements; and the coloured opaque bands of the first screen are aligned with the coloured bands of the second screen in the said first direction.

A person of average height, whose eyes are not on the axis of an indicator light according to the invention, i.e. the person is looking at the light in the first direction, but whose eyes are in particular above the level of the axis, will then see the coloured opaque bands of the first screen through the translucent bands of the second screen, giving a coloured appearance to the translucent bands when the indicator light is extinguished. This improves the overall uniformity of the appearance of the indicator light.

The translucent bands of the second screen preferably have an overall width which is less than that of the coloured bands of the same screen.

The said lines of optical elements preferably consist of convex cylindrical lens elements which are formed on the surface of the said first screen that faces towards the flux recuperating means.

According to a preferred feature of the invention, the distance by which the first screen is separated from the second screen is of the same order as the focal distance of the optical elements of the first screen.

The surface of the first screen that faces towards the second screen is preferably essentially smooth.

In some embodiments of the invention, the opaque coloured bands of the first screen are formed by marking the latter, for example by a suitable printing process. In another version, these opaque coloured bands are formed on the first screen by moulding in an opaque coloured material.

In other embodiments, the opaque coloured bands of the first screen are in the form of coloured catadioptric elements.

The surfaces of the coloured bands of the second screen facing towards the first screen may be smooth, or they may be provided with catadioptric elements.

The opaque coloured bands of the first screen and the coloured bands of the second screen are preferably of the same colour.

The indicator light typically includes a casing which is open towards the front to allow the light to pass out of the indicator light, the various components of the latter being mounted within this casing. In that case, the second screen may also constitute a closure glass or cover lens for the said casing.

Further features and advantages of the invention will appear more clearly on a reading of the following detailed description of some preferred embodiments of the invention, which is given by way of non-limiting example only and with reference to the accompanying drawings.

DESCRIPTION OF PREFERRED EMBODIMENTS OF THE INVENTION

The whole of the following description is concerned with an indicating light (as defined above under "Field of the Invention") which has only one function. This is in the interests of simplicity: however, it is to be clearly understood that the invention is also applicable to such lights as those having plural functions. Indeed, it is of greatest interest in this particular application, in which each function of the light, or light unit, will be realised in accordance with the features of the present invention.

The example of a light (or light unit) described below is, specifically, a reversing light giving a red display, the emitted light being white.

Figure 1:
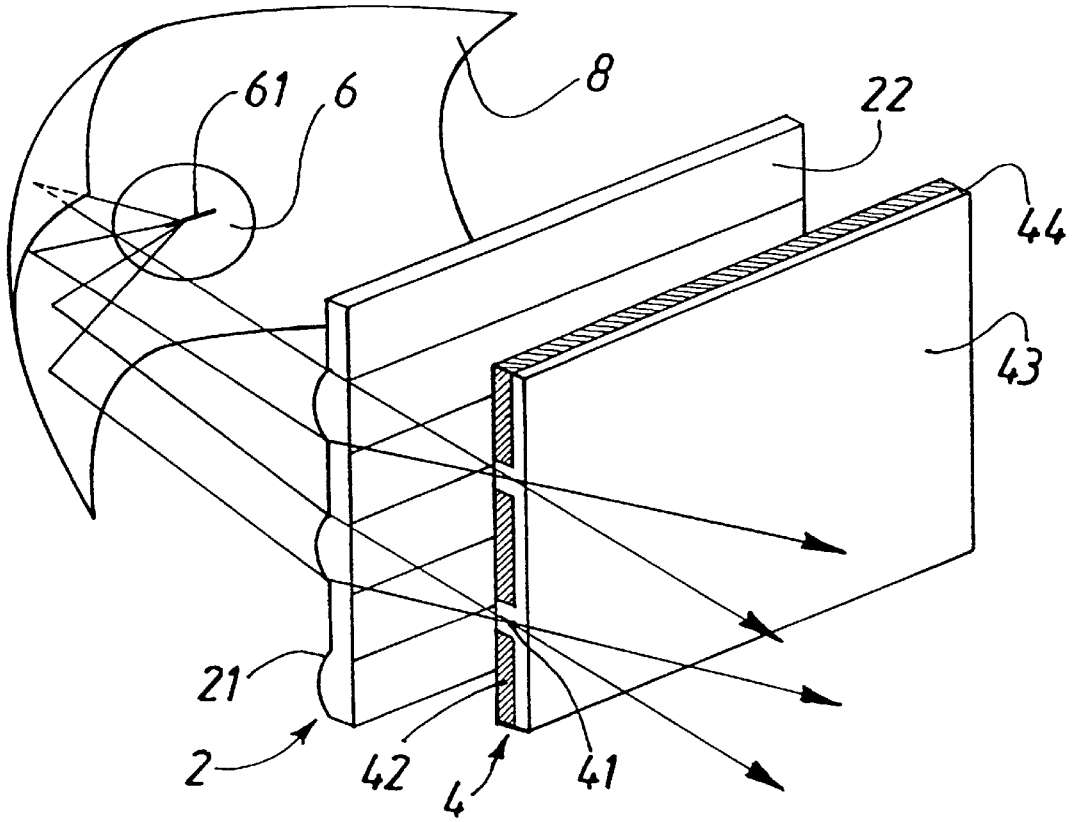
FIG. 1 is a perspective view showing a first embodiment of the invention.

With reference to FIG. 1, the reversing light here shown comprises, within a housing, not shown, a lamp 6 having a filament 61 which is the light source. Light flux recuperating means are associated with the lamp 6. These means comprise, in this example, a reflector 8, which directs the whole of the light flux emitted by the lamp 6 towards the front of the light unit (i.e. towards the rear of the vehicle) in a first general direction which is that commonly referred to as the axis of the light. The reflector 8 is preferably arranged to retransmit a light beam which is spread in the horizontal direction but not spread in the vertical direction, that is to say the projections of the light rays, in any given vertical plane extending parallel to the axis, form a parallel beam, or in other words the vertical component of eacg light ray is zero. Such a parallel beam is shown diagrammatically in FIG. 1.

In another version, the recuperating means 8 could for example, instead being in the form of a reflector, be a Fresnel recuperator placed in front of the lamp 6.

In front of the reflector 8 (or other recuperating means) in the above mentioned first direction, the light includes a first screen 2 on which lines 21 of optical elements are formed. In this embodiment, these lines 21 of optical elements are in the form of godroons, that is to say they constitute cylindrical convex lens elements. The lens elements extend on the surface of the screen 2 that faces towards the reflector 8 in a second or transverse horizontal direction which is essentially at right angles to the first direction. The lens elements thus give vertical convergence to the light beam which is re-emitted by the reflector 8. The light beam modified in this way is preferably arranged to satisfy the relevant standards, by virtue of the successive horizontal spacings given by the reflector and vertical spacings given by the first screen.

The lines 21 of optical elements do not occupy the whole of the surface of the first screen 2, but are spaced apart from each other. This conforms with an essential feature of the invention. Between the lines 21, the first screen 2 consists of opaque coloured bands 22, which again extend in the second direction as shown in FIG. 1. The term "opaque band" here means that the light is unable to pass through the band of material in the first direction and therefore towards the outside of the indicator light. In the present example, the opaque bands 22 are coloured red.

Thus, when the light is switched on, the light beam emitted from the reflector 8 passes through the screen 2 only via its lines 21 of optical elements.

The surface of the first screen 2 that faces towards the outside of the indicator light, that is to say forwards in the first direction, is essentially smooth.

Figure 2:
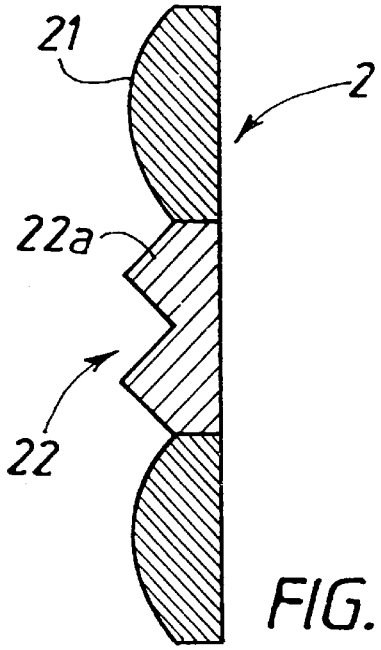
FIG. 2 is a view in cross section of a screen in the same embodiment of the invention.

Referring now to FIG. 2, in the embodiment shown in this Figure the coloured opaque bands 22 are in the form of catadioptric elements 22*a* projecting backwards towards the reflector 8, so as to reflect light which they receive from outside the indicator light. In this version it can also be of advantage to provide suitable masking strips (not shown) between the first screen 2 and the reflector 8, so that no light ray emitted by the reflector 8 is able to become incident on the catadioptric elements 22*a*.

Figure 3:
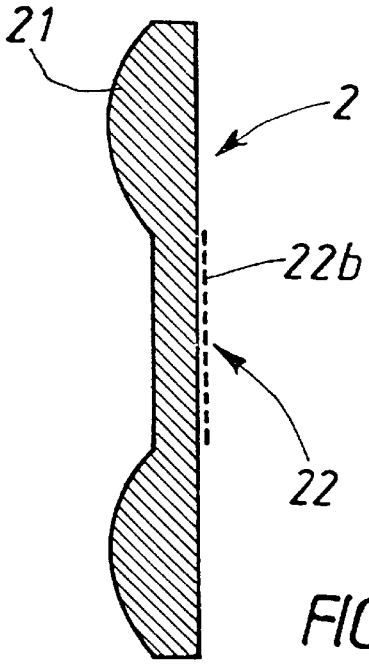
FIG. 3 is a view in cross section of a modified version of the screen.

In the alternative version shown in FIG. 3, the bands 22 which lie between the optical element lines 21 are applied on the face opposite to the reflector 8, the bands 22 facing towards the reflector 8 being smooth. The applied marking thus applied on the front face of the screen 2 between the optical elements 21, in this example by printing, makes the bands 22 opaque, and also gives them the desired colour as seen from outside the indicator light. In another version, the coloured opaque bands 22 can be applied by superimposing strips of a coloured opaque material by moulding on the first screen 2.

A second screen 4 is arranged in front of the first screen 2. This second screen 4 consists of translucent bands 41, which are uncoloured in this example and which are arranged alternately with coloured bands 42. All of these bands 41 and 42 extend essentially in the second, i.e. transverse direction, that is to say they are essentially parallel to the opaque coloured bands 22 and lines of optical elements 21 in the first screen 2. The translucent bands 41 of the second screen 4 are aligned with the lines of optical elements 21 of the screen 2, so that they transmit without any modification the light beam received from the first screen 2.

In another version, it may be envisaged that the translucent bands 41 of the screen 4 are coloured instead of being uncoloured, so as to give some colour to the light beam emitted by the indicator light.

The opaque coloured bands 22 of the first screen 2 are aligned with the coloured bands 42 of the second screen 4. The coloured bands 42 of the screen 4 and the coloured opaque bands 22 of the screen 2 will preferably be of the same colour, this being red in the present example.

The net width of the translucent bands 41 of the screen 4 is preferably less than that of the coloured bands 42 of the same screen. Thus, the surface of the screen 4 that faces towards the front, i.e. towards the outside of the indicator light, is mainly coloured, and this improves even more the coloured appearance of the indicator light when the latter is extinguished, so that in this example it appears to be red.

In addition, the second screen 4 is located at a distance of the same order as the focal distance of the cylindrical lenses 21 in the screen 2. Accordingly, the second screen 4 lies at approximately the point of convergence of the light beam, as shown in FIG. 1, and the extent of each translucent band 41 of the second screen 4 is reduced to a minimum. This distance between the two screens 2 and 4 also gives the indicator light an appearance of depth.

In this first embodiment, the surfaces of the coloured bands 42 and the translucent bands 41 of the second screen 4, facing towards the first screen 2, are smooth.

In the preferred arrangement shown in FIG. 1, the surfaces of the coloured bands 42 and those of the translucent bands 41 of the second screen 4 that face towards the outside of the indicator light are overlaid with a layer 44 of translucent material, which is preferably uncoloured and formed by moulding integrally with the translucent bands 41 of the screen 4. This layer 44 therefore defines the front face 43 of the screen 4 which faces towards the outside of the indicator light. Because the layer 44 is both translucent and uncoloured, it does not in any way alter the light emitted by the indicator light, and nor does it alter the appearance of the latter when extinguished. On the other hand, it does enable the moulding of the second screen 4 to be simplified, because it makes it possible to mould all of the translucent bands 41 of the screen 4 in a single injection moulding operation. In addition, the solidity, or cohesion, of the second screen 4 is increased.

The front face 43 of the second screen 4 is preferably made smooth as shown, and the screen 4 can then also serve as the outer cover for the housing or casing of the indicator light unit. In another version, however, an outer cover (not shown), separate from the second screen, may of course be provided in front of the screen 4.

Figure 4:
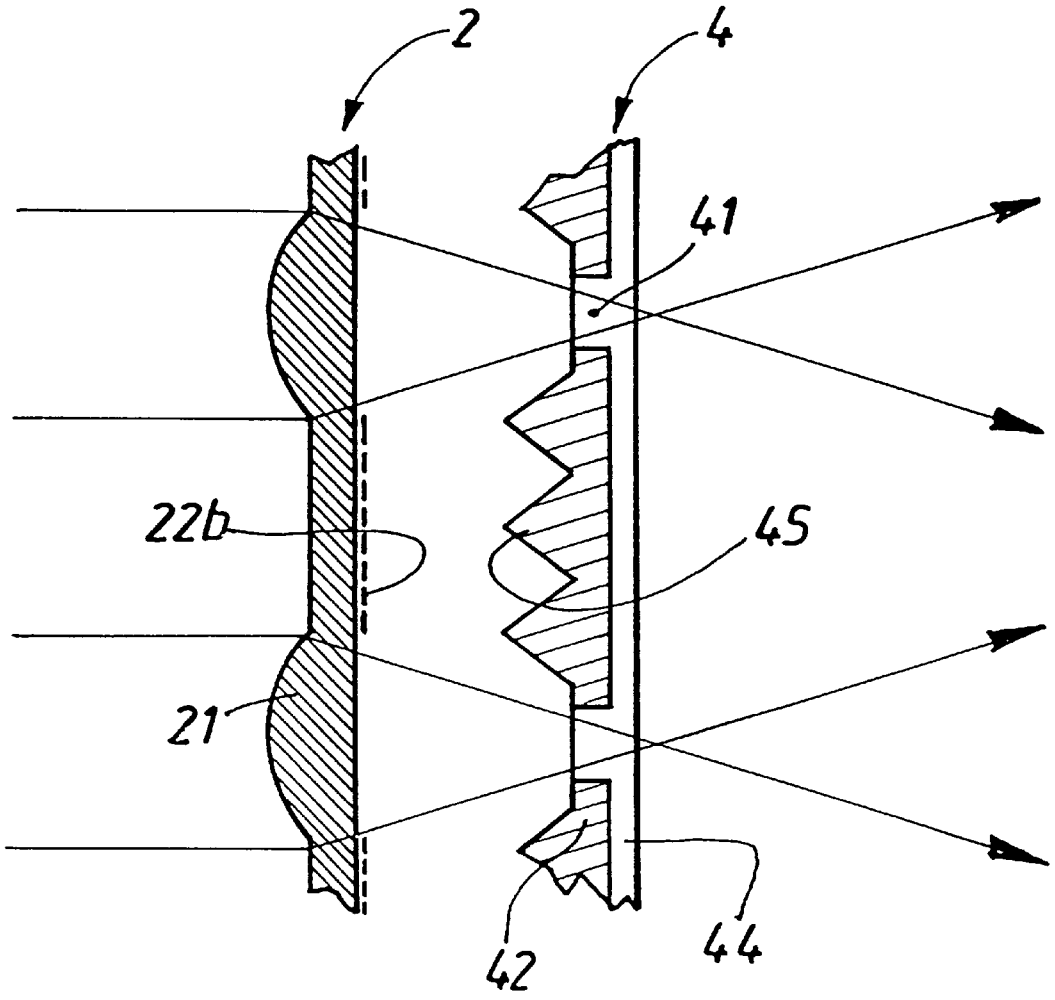
FIG. 4 is a view in cross section showing two screens and illustrating a second embodiment of the invention.

Reference is now made to FIG. 4, showing a second embodiment of the invention, in which those elements which are similar to the embodiment shown in FIGS. 1 and 3 are designated by the same reference numerals as those used in the preceding Figures. In this second embodiment, the coloured opaque bands 22 of the first screen 2 are formed by being marked on the latter as in the version described above with reference to FIG. 3. On the other hand the surfaces of the coloured bands 42 of the second screen 4 that faces towards the rear of the light unit, i.e. towards the first screen 2, instead of being smooth as before, are provided with catadioptric elements 45. This improves the opacity of the combination of the coloured opaque bands 22 of the first screen 2 and the coloured bands 42 of the second screen 4.

The invention is of course not limited to the embodiments described above. In particular, it is possible to combine these various versions without departing from the scope of the present invention. For example, the coloured opaque bands 22 of the first screen 2 could be in the form of uncoloured catadioptric elements, the projecting portions of which project towards the reflector 8, with bands of a translucent coloured material being applied by moulding on the surface of the first screen 2 that faces towards the second screen 4.

What is claimed is:

1. An indicator light for a motor vehicle, comprising:

a flux recuperating means defining a first direction of the indicator light;

a light source disposed in relation to the recuperating means in a position whereby the recuperating means can receive a light flux from the source and redirect the flux forwards in the first direction;

a first screen in front of the recuperating means, the first screen comprising a plurality of lines of optical elements extending in a second direction substantially at right angles to the first direction, whereby the optical elements can receive the light flux in the form of a beam from the recuperating means and converge the beam forwardly; and a second screen disposed in front of the first screen and spaced away from the first screen, the second screen including, over at least part of its thickness, colored bands and translucent bands arranged alternately with the colored bands, the colored and the translucent bands being oriented substantially in the second direction, wherein the lines of optical elements are spaced apart from each other, the first screen further including opaque colored bands separating the lines of optical elements from each other, and said colored opaque bands being aligned in the first direction with the colored bands of the second screen.

2. A light according to claim 1, wherein the colored bands of the second screen define a first overall width, and the translucent bands of the second screen define a second overall width smaller than the first overall width.

3. A light according to claim 1, wherein the first screen has a rear surface facing towards the recuperating means, the lines of optical elements comprising convex cylindrical lens elements extending in said second direction on the rear surface of the first screen.

4. A light according to claim 1, wherein the distance separating the first and second screens from each other is of the same order as the focal length of the optical elements.

5. A light according to claim 1, wherein the first screen has a substantially smooth front surface facing towards the second screen.

6. A light according to claim 1, wherein the second screen includes at least one applied marking which constitutes the opaque colored bands.

7. A light according to claim 1, wherein the first screen includes elements molded thereon of an opaque colored material and constituting the opaque colored bands.

8. A light according to claim 1, wherein the opaque colored bands of the first screen are in the form of colored catadioptric elements.

9. A light according to claim 1, wherein the second screen has a rear surface facing towards the first screen, the surface including the surfaces of the bands of the second screen, the surfaces of the colored bands being smooth.

10. A light according to claim 1, wherein the colored bands of the second screen have rear surfaces including catadioptric elements, facing towards the first screen.

11. A light according to claim 1, wherein the opaque colored bands of the first screen and the colored bands of the second screen are of the same color.

12. A light according to claim 1, further comprising:

a casing open towards the front, the light source, recuperating means and first and second screens being contained in the casing, whereby to emit light from the indicating light through the open front of the casing, the second screen constitutes a front cover of the indicating light.

13. A device comprising:

a light source configured to generate a light flux;

a baffle disposed to receive the light flux having (a) a plurality of optical elements arranged transverse to a beam direction of the flux and (b) an opaque colored material interposed between the optical elements; and a cover screen having (a) a plurality of optically transparent apertures, beam-aligned with the optical elements and (b) colored material interposed between at least some of the apertures.

14. The device according to claim 13, wherein the baffle is roughly planar.

15. The device according to claim 13, wherein the cover screen is roughly planar.

16. The device according to claim 13, wherein the optical elements and the opaque material of the baffle are alternating, parallel bands.

17. The device according to claim 13, further comprising a flux recuperator arranged to receive the light flux from the light source and redirecting the flux forwards in the beam direction toward the optical elements.

18. The device according to claim 17, wherein the flux recuperator is a reflector.

19. The device according to claim 17, wherein the flux recuperator is a Fresnel recuperator.

20. The device according to claim 13, wherein optical elements are convex cylindrical lens elements on the rear surface of the baffle, facing towards the light source.

21. The device according to claim 13, wherein the front surface of the baffle, facing towards the cover screen, is substantially smooth.

22. The device according to claim 13, wherein the opaque material is a plurality of molded elements.

23. The device according to claim 13, wherein the opaque material is a plurality of catadioptric elements.

24. The device according to claim 13, wherein the distance, in the beam direction, between the baffle and the cover screen is of the same order as the focal length of the optical elements.

25. The device according to claim 13, wherein the colored material and the opaque material are substantially the same color.

26. The device according to claim 13, wherein the colored material comprises only part of the thickness of the cover screen.

27. The device according to claim 13, wherein the rear surface of the cover screen, facing towards the baffle, comprises the colored material.

28. The device according to claim 27, wherein the surface of the colored material is substantially smooth.

29. The device according to claim 27, wherein the surface of the colored material is a plurality of catadioptric elements.

30. The device according to claim 13, wherein the colored material is an applied material.

31. The device according to claim 30, wherein the applied material is applied by printing.

32. The device according to claim 13, wherein the apertures are uncolored translucent apertures.

33. The device according to claim 13, wherein the apertures of the cover screen are colored translucent apertures.

34. The device according to claim 13, wherein the colored material defines a first overall area of the cover screen, and the apertures define a second overall area smaller than the first overall area.

35. A motor vehicle comprising a device including (1) a light source configured to generate a light flux; (2) a baffle disposed to receive the light flux having (a) a plurality of optical elements arranged transverse to a beam direction of the flux and (b) an opaque colored material interposed between the optical elements; and (3) a cover screen having (a) a plurality of optically transparent apertures, beam-aligned with the optical elements and (b) a colored material interposed between at least some of the apertures.

* * * * *

UNITED STATES PATENT AND TRADEMARK OFFICE

CERTIFICATE OF CORRECTION

PATENT NO. : 5,933,084

DATED : August 3, 1999

INVENTOR(S) : Jean-Paul Ravier and Benoist Fleury

It is certified that error appears in the above-identified patent and that said Letters Patent is hereby corrected as shown below:

ON THE TITLE PAGE:

Please add item --[73] Assignee: Valeo Vision, 34 rue Saint Andre, Bobigny Cedex, France 93012.

Signed and Sealed this

Twenty-second Day of February, 2000

*Attest:*

Q. TODD DICKINSON

*Attesting Officer*

*Commissioner of Patents and Trademarks*